United States Patent [19]

Griffin et al.

[11] Patent Number: 4,563,302

[45] Date of Patent: Jan. 7, 1986

[54] SULFURIZED OLEFIN PROCESS

[75] Inventors: Paul G. Griffin, Collinsville, Ill.; William Y. Lam, St. Louis, Mo.

[73] Assignee: Edwin Cooper, Inc., St. Louis, Mo.

[21] Appl. No.: 556,968

[22] Filed: Dec. 1, 1983

[51] Int. Cl.[4] ..... C10M 1/38

[52] U.S. Cl. ..... 252/45; 568/18; 568/59

[58] Field of Search ..... 252/45; 260/125

[56] References Cited

U.S. PATENT DOCUMENTS

| | | | |
|---|---|---|---|
| 2,249,312 | 7/1941 | Kimball | 252/48.8 |
| 2,708,199 | 5/1955 | Eby | 252/45 |
| 3,471,404 | 10/1969 | Myers | 252/45 |
| 4,188,297 | 2/1980 | Jayne et al. | 252/45 |
| 4,204,969 | 5/1980 | Papay et al. | 252/45 |

*Primary Examiner*—William R. Dixon, Jr.
*Assistant Examiner*—Cynthia A. Prezlock
*Attorney, Agent, or Firm*—Donald L. Johnson; John F. Sieberth; W. G. Montgomery

[57] ABSTRACT

A sulfurized olefin of improved solubility in lubricating oil is made by reacting sulfur monochloride with a monoolefin (e.g. isobutylene) to form an adduct which is reacted with sodium sulfide, sodium hydrosulfide, sulfur and alkyl mercaptan (e.g. tert-butyl mercaptan) in an aqueous alcohol reaction medium.

24 Claims, No Drawings

SULFURIZED OLEFIN PROCESS

BACKGROUND OF THE INVENTION

Sulfurized olefins are well-known additives in lubricating oil, cutting oil and the like. Kimball, U.S. Pat. No. 2,249,312, describes such a product. Eby, U.S. Pat. No. 2,708,199, describes a similar product in which a sulfur halide is reacted with an olefin using a lower alkanol promoter to obtain an intermediate which is reacted with an alkali or alkaline earth metal polysulfide. Myers, U.S. Pat. No. 3,471,404, describes a product in which sulfur monochloride is reacted with olefin to obtain an intermediate which is reacted with sulfur and alkali metal sulfide at a critical ratio of 1.8–2.2 gram moles of metal sulfide per gram mole of sulfur. This material is then refluxed for 1–24 hours with aqueous alkali metal hydroxide. In U.S. Pat. No. 4,204,969, an effective sulfurized olefin is made by reacting sulfur monochloride with an olefin in the presence of a lower alkanol promoter to obtain an adduct which is reacted with sodium sulfide and sulfur in aqueous alkanol.

SUMMARY OF THE INVENTION

According to the present invention, a sulfurized olefin having improved solubility especially in α-olefin oligomer lubricating oil is made by reacting a monoolefin with $S_2Cl_2$ or $SCl_2$ to obtain an adduct which is reacted with sodium sulfide, sulfur, alkyl mercaptan and optionally sodium hydrosulfide in an aqueous alcohol reaction medium.

DESCRIPTION OF PREFERRED EMBODIMENTS

A preferred embodiment of this invention is a process for making a sulfurized olefin having improved solubility in lubricating oil said process comprising:

(a) reacting a sulfide halide selected from $SCl_2$, $S_2Cl_2$ and mixtures thereof with an aliphatic monoolefin containing 3–6 carbon atoms to produce an adduct;

(b) reacting said adduct with sulfur, $Na_2S$, an alkyl mercaptan containing 1–12 carbon atoms and optionally NaSH in an aqueous alcohol medium at a temperature of 50° C. up to reflux to form said sulfurized olefin;

(c) recovering said sulfurized olefin from the aqueous alcohol medium.

Although a useful product can be obtained using either $SCl_2$ or $S_2Cl_2$, superior results were obtained with $S_2Cl_2$ so this sulfur halide is most preferred.

Useful olefins are the monoethylenically unsaturated aliphatic hydrocarbons referred to as aliphatic monoolefin containing 3 to about 6 carbon atoms. These include 1-butene, 2-butene, isobutene, 1-pentene, 2-pentene, 2-methyl-1-butene, 3-methyl-1-butene, 2-methyl-2-butene, 1-hexene, 2-hexene, 3-hexene, 2-methyl-1-pentene, 2-methyl-2-pentene, 2-ethyl-2-butene and the like including mixtures thereof.

Preferably the olefins are branched-chain olefin such as isobutene, 2-methyl-1-butene, 2-methyl-2-butene, 2-methyl-2-pentene and the like. More preferably the ethylenic double bond adjoins a tertiary carbon atom such as isobutylene, the most preferred olefin.

The first stage reaction is preferably conducted by adding the olefin to sulfur monochloride. The olefin can be added as a gas or liquid. Preferably it is added beneath the surface of the sulfur monochloride as a liquid.

In practice the olefin is added until the reaction with the sulfur monochloride stops as indicated by loss of exotherm. An amount of about 0.75–3.0 gram moles of olefin for each 0.3–0.75 gram mole of sulfur monochloride usually suffices. A preferred amount is about 1.5–2.0 gram moles of olefin per gram mole of sulfur monochloride.

The reaction between sulfur monochloride and olefin will proceed without adding an alcohol promoter, but the use of an alcohol promoter is included in one embodiment of the invention. Lower alcohol promoters which can be used in the first stage contains from about 1 to about 4 carbon atoms such as methanol, ethanol, n-propanol, isopropanol, isobutanol, tert-butanol and the like. A preferred promoter is methanol.

The amount of alcohol promoter is preferably about 0.001 to about 0.3 gram moles for each 0.3–0.75 gram mole of sulfur monochloride. However use of an alcohol promoter causes corrosion of metal equipment so is not highly preferred.

The first stage reaction can be conducted at any temperature high enough to cause the reaction to proceed, but not so high as to cause decomposition of the reactants or products. A useful range is about 30°–100° C. A more preferred range is about 40°–75° C. and a most preferred range is about 50°–60° C.

The first stage reaction should be conducted for a time sufficient to complete the reaction between the sulfur chloride and olefin. This is usually limited by heat removal. Olefin feed rate is preferably controlled to hold the temperature within the desired range. When the sulfur chloride has been consumed the temperature will drop. External heat may be added to continue the reaction for a further time, but this does not appear to be necessary. The overall time required to complete the reaction depends upon the scale of the process and can vary from a few minutes up to 12 or more hours. The time is not critical.

During the first stage reaction HCl gas is evolved so means should be provided to scrub the vent gas from the reactor to remove HCl prior to releasing it to the atmosphere.

In the second stage reaction, adduct from the first stage is reacted with sodium sulfide, sulfur, alkyl mercaptan and optionally sodium hydrosulfide in an aqueous alcohol reaction medium. The second stage is preferably carried out by charging aqueous sodium hydrosulfide, sodium hydroxide, water, alcohol and elemental sulfur flowers or powdered sulfur to a reactor and then adding the adduct and alkyl mercaptan to this at reaction temperature. The NaSH and NaOH react to form sodium sulfide. Excess NaSH remains.

The sodium sulfide may be obtained from any of a number of sources. For example, it can be made by mixing approximately equal mole amounts of sodium hydrosulfide and sodium hydroxide. If hydrogen sulfide is available, it can be adsorbed in aqueous NaOH to form a solution of sodium sulfide and/or sodium hydrosulfide depending upon the amount of hydrogen sulfide adsorbed. Whatever the source, the resulting solution should be adjusted with either NaOH, NaSH or $H_2S$ so that the resulting solution consists mainly of sodium sulfide and optionally sodium hydrosulfide with little or no free sodium hydroxide.

The amount of sodium sulfide can vary somewhat. For example, from about 0.5–1.0 gram mole for each gram mole of sulfur monochloride used in the first reaction stage. Preferably the amount of sodium sulfide is about 0.5–2.0 gram mole per mole of sulfur monochloride and most preferably about 0.6–0.9 gram mole per gram mole sulfur monochloride.

Presence of NaSH is optional. Use of up to 0.5 gram moles of NaSH per mole of $S_2Cl_2$ has given satisfactory results. A preferred amount is about 0.1–0.3 gram moles and most preferably 0.25 moles per mole of $S_2Cl^2$.

The amount of water can vary widely without detrimental effect. Good results can be obtained using about 10–20 gram moles of water per gram mole of sodium sulfide. This includes water added as such, water in aqueous reactants and water which might be formed by reaction of hydrogen sulfide or sodium hydrosulfide with sodium hydroxide in forming sodium sulfide solution.

Alcohol is required in the second stage reaction. Preferably, these are lower alcohols containing 1–4 carbon atoms such as methanol, ethanol, n-propanol, n-butanol, isobutanol, tert-butanol and the like, including mixtures thereof. The preferred alcohol is isopropanol either alone or mixed with other alkanols such as tert-butanol.

The amount of alcohol can likewise vary over a wide range. A useful range is about 0.25–0.75 parts by weight per each part by weight of water. A more preferred range is about 0.4–0.6 parts by weight alcohol per each part by weight water.

The alkyl mercaptan can be added separately to the aqueous alcohol reaction medium or it can be mixed with the first stage adduct and the mixture added to the aqueous alcohol containing the sodium sulfide and sulfur. When added separately it is preferred that it be added concurrently with the first stage adduct to the aqueous alcohol containing the sodium sulfide and sulfur. Sequential addition can be used but it is not preferred.

Useful alkyl mercaptans include those in which the alkyl group contains 1 to about 12 carbon atoms. Representative example of these are methyl mercaptan, ethyl mercaptan, n-propyl mercaptan, i-propyl mercaptan, n-butyl mercaptan, isobutyl mercaptan, sec-butyl mercaptan, tert-butyl mercaptan, n-pentyl mercaptan, isopentyl mercaptan, tert-pentyl mercaptan, 2-ethyl hexyl mercaptan, n-octyl mercaptan, 1-methyl-heptyl mercaptan, 1-ethyl-decyl mercaptan and the like including mixtures thereof.

Of the foregoing the more preferred mercaptans are the tert-alkyl mercaptans. Of these the more preferred are the tert-alkyl mercaptans containing about 4–8 carbon atoms. The most preferred alkyl mercaptan is tert-butyl mercaptan.

The amount of alkyl mercaptan can vary over a wide range. A useful range in which to test is about 0.05 to 0.8 moles for each mole of sulfur monochloride used in the first stage. A preferred range is about 0.08 to 0.5 moles of alkyl mercaptan per mole of sulfur monochloride and a more preferred range is about 0.1 to 0.4 moles per mole of sulfur monochloride. The most preferred amount of alkyl mercaptan is about 0.25 to 0.35 moles per mole of sulfur monochloride.

The preferred amount of sulfur added is 0–0.3 gram atom for each gram mole of $S_2Cl_2$. More preferably, about 0.05–0.15 gram atom of sulfur and most preferably 0.1–0.15 are used per gram mole of $S_2Cl_2$.

In a preferred mode of operation the mixture of sodium sulfide, sulfur and aqueous alkanol is stirred and heated to reaction temperature and then the adduct and alkyl mercaptan are added to it. However, the reaction can be carried out in other ways such as by adding the sodium sulfide, sulfur, alkyl mercaptan and aqueous alkanol mixture to the adduct or by mixing everything together and heating the mixture.

Preferred second stage reaction temperature is about 50° C. up to reflux temperature. A more preferred reaction temperature is about 75°–85° C.

After the adduct and alkyl mercaptan have been added to the sodium sulfide/sulfur/aqueous alkanol mixture, which is usually completed in about 1–8 hours, the mixture is preferably heated to just below reflux for about 2–8 hours to assure completion of the reaction.

A very convenient way in which to make an effective sulfurized isobutylene is to base the amount of $Na_2S$ and NaSH (or NaOH plus NaSH or NaOH plus $H_2S$), sulfur and tert-butyl mercaptan on the weight of $S_2Cl_2$-isobutylene adduct. Following this procedure the Kg of $Na_2S$, NaSH, sulfur and tert-butyl mercaptan per each 100 Kg of sulfurized isobutylene is preferably 15–45:0–12:0–7.5:3–20:100, more preferably 20–35:2–10:1–6:4–18:100 and most preferably 25–30:4–8:2–5:5–15:100.

After reaction of the adduct with sodium sulfide, sodium hydrosulfide, alkyl mercaptan and sulfur the product is recovered by conventional methods such as removing alkanol, water washing and filtering.

The following example illustrates the manner of making the sulfurized olefin.

EXAMPLE 1

A sulfurized isobutylene adduct was made by adding isobutylene to sulfur monochloride at about 50°–65° C. until reaction stopped. In a separate vessel was placed 177.9 g aqueous alcohol (64.7 wt % isopropanol, 13.8 wt % tert-butanol, 20.3 wt % water), 23.4 g water, 240.4 g 29.09% aqueous NaSH solution (0.9 moles), 76.2 g 81.6 g 50% aqueous NaOH solution (0.95 moles) and 12.3 g (0.38 moles) sulfur. This was stirred at about 75° C. while 255.3 g of the above adduct and 32.0 g tert-butyl mercaptan (0.36 moles) were concurrently added dropwise over a two hour period. Heat was continued at reflux for three hours and then solvent alcohol was distilled out up to 90° C. Vacuum was applied to remove more solvent. Heat was stopped and when the mixture cooled to 65° C. the mixture was washed with water. The aqueous brine layer was removed and the organic layer was stripped of volatiles under vacuum at 100°–110° C. for one hour and then filtered a second time giving a clear amber product which analyzed 47.7 weight percent sulfur.

EXAMPLE 2

In a reaction vessel was placed 188.4 g aqueous alcohol (same as in Example 1), 23.3 g water, 246.0 g 29.09 wt % aqueous NaSH (1.27 moles), 78.0 g 50% aqueous NaOH (0.98 moles) and 6.1 g sulfur (0.44 moles). This mixture was stirred and heated to 75° C. and then 270.0 g of the sulfurized isobutylene adduct described in Example 1 was fed to the reaction mixture together with 33.9 g tert-butyl mercaptan over a two hour period at 75° to reflux. Reflux was continued for three hours and then solvent was distilled out up to liquid temperature of 90° C. Vacuum was applied and heating stopped. When the temperature dropped to 65° C. water was added to wash the organic phase. The lower aqueous brine layer was removed. The organic phase was stripped under vacuum at 100°–110° C. for one hour and then filtered using a filter aid. Product analyzed 43.6 weight percent sulfur.

EXAMPLE 3

In a reaction vessel was placed 100.41 g of a 34.3 wt % aqueous solution of NaSH containing 1.03 wt % $Na_2S$, 37.27 g of a 50 wt % aqueous NaOH solution, 4.0 g of sulfur, 43.64 g water and 86.19 g of a mixture of 67.17 wt % isopropanol, 16.89 wt % tert-butanol and the balance water. This was stirred and heated to 75° C. at which time 133.47 g of $S_2Cl_2$-isobutylene adduct made by adding isobutylene to $S_2Cl_2$ at 60° C. to the point where no further isobutylene would react was added concurrently with 6.66 g tert-butyl mercaptan over a two hour period. Stirring was continued at reflux (about 80° C.) for three hours at which time alcohol-water was distilled out up to 90° C. Vacuum was applied and distillation continued until 70° C. liquid temperature at a vacuum of twenty-four inches Hg. The mixture was then water washed at 70° C. Wash water was drained off and 1% Dicalite filter aid added. The mixture was stirred at 100°-105° C. at 28" Hg vacuum for one hour and then filtered. Product analyzed 48.8 weight percent sulfur.

EXAMPLE 4

Another product was made following the same procedure as Example 3 except using 98.27 g 34.3 wt % aqueous NaSH, 36.48 g 50 wt % aqueous NaOH, 2.95 g sulfur, 42.70 g water, 84.66 g of same aqueous isopropanol tert-butanol solution 16.33 g tert-butyl mercaptan and 130.64 g $S_2Cl_2$-isobutylene adduct. The product analyzed 46.4 weight percent sulfur.

EXAMPLE 5

This example followed the same procedure as Example 3 except using 94.85 g 35.04 wt % aqueous NaSH, 35.96 g 50 wt % aqueous NaOH, 6.22 g sulfur, 29.77 g water, 99.83 g 56.39 wt % isopropanol-13.85 wt % tert-butanol-water solution, 16.21 g tert-butyl mercaptan and 129.70 g $S_2Cl_2$-isobutylene adduct. The product analyzed 48 weight percent sulfur.

The sulfurized olefins are especially useful in lubricating oil formulations used in gear applications. The base oil may be a mineral oil or a synthetic oil. Useful synthetic oils include olefin oligomers such as decene trimer, tetramer and pentamer made by oligomerizing 1-decene using a $BF_3$ catalyst. Useful olefin oligomers can be made using other catalysts such as the aluminum alkyl Ziegler catalyst. Likewise, other olefins can be used such as $C_{6-14}$ 1-olefins.

Synthetic alkylbenzenes can also be used such as di-dodecylbenzene and the like.

Synthetic ester lubricating oil can also be employed such as the alkyl esters of dicarboxylic acid (e.g. di-2-ethylhexylsebacate), fatty acid esters of polyols (e.g. trimethylolpropane, tripelargonate) or complex esters of alkanols, alkane, polyols and carboxylic or polycarboxylic acid.

In this use the sulfurized olefin is added in an amount sufficient to improve the EP property of the lubricant. An amount of 0.1 to 10.0 wt % is usually sufficient.

Fully formulated gear lubricants include other conventional additives which perform various functions. Examples of such other additives are corrosion inhibitors for ferrous and non-ferrous metals such as tetrapropenyl succinic acid and bis-(2,5-alkyldithia)-1,3,4-thiadiazoles. Antiwear additives such as alkyl or aryl phosphonates, phosphite, thiophosphates, dithiophosphates, and phosphoric acids. Also zinc dialkyl or diaryl dithiophosphate, chlorinated hydrocarbons, sulfurized fatty esters and amines.

Tests have been conducted which demonstrate the EP effectiveness of the sulfurized olefin.

The tests were conducted in SAE 90 mineral oil. The first was a 4-ball weld test (ASTM D2783) in which a steel ball is rotated in loaded contact with three fixed balls. The maximum load without weld is recorded as the pass load.

The test additive was blended in the base oil at a concentration which imparted 1.0 weight percent sulfur to the oil. Results obtained were as follows:

| Additive of | Weld Load (Kg) |
|---|---|
| Example 1 | 315 |
| Example 2 | 315 |
| Example 3 | 315 |
| Example 4 | 315 |
| Example 5 | 315 |

In another standard test the present additive was used as a component in a formulated gear oil. The test was an L-42 High Speed Axle Test. Using the additives of Example 1 or 2 gave a gear oil which passed the test.

The mercaptan-capped sulfurized olefins of this invention have been found to be much more soluble in hydrogen-treated mineral oil and α-olefin oligomer synthetic lubricating oil compared to the same sulfurized olefin made without mercaptans. In the first comparison blends were made at 4.0 weight percent sulfurized olefin in a hydrotreated base oil, a hydrocracked base oil an α-decene oligomer. The blends were rated as clear or cloudy. The results were as follows:

| Additive | Hydrotreated Base Oil | Hydrocracked Base Oil | α-Decene Oligomer |
|---|---|---|---|
| Example 1 | clear | clear | clear |
| Example 2 | clear | clear | clear |
| Example 3 | clear | clear | cloudy |
| Example 4 | clear | clear | clear |
| Example 5 | clear | clear | clear |
| Standard[1] | cloudy | cloudy | cloudy |

[1]Sulfurized isobutylene made without alkyl mercaptan.

Further solubility tests were conducted to determine the solubility limits of the different additives in a SAE 90W α-decene oligomer. The following table gives the maximum concentration for a clear solution and concentration at cloudy mixture:

| | Concentration (wt %) | |
|---|---|---|
| Additive | Clear | Cloudy |
| Example 3 | 3 | 4 |
| Example 4 | 8 | 9 |
| Example 5 | 5 | 6 |
| Standard | — | 1 |

These results show the improvement in solubility in a synthetic α-olefin oligomer gear oil base stock due to use of the alkyl mercaptan.

We claim:

1. A process for making a sulfurized olefin having improved solubility in lubricating oil said process comprising:

(A) reacting a sulfur halide selected from $S_2Cl_2$ and $scl_2$ with an aliphatic monoolefin contianing 3-6 carbon atoms to produce an adduct (B) reacting said adduct with sulfur, $Na_2S$, an alkyl mercaptan containing 1–12 carbon atoms and from 0–0.5 grams NaSH per mol sulfur halide in an aqueous alcohol medium at a temperature of 50° C. up to reflux to form said sulfurized olefin (C) recovering said sulfurized olefin from said aqueous alcohol medium.

2. A process of claim 1 wherein said sulfur halide is $S_2Cl_2$.

3. A process of claim 2 wherein said monoolefin is a branched chain monoolefin having 4 to about 6 carbon atoms.

4. A process of claim 3 wherein said monoolefin is isobutylene.

5. A process of claim 4 wherein said alkyl mercaptan is a tert-alkyl mercaptan.

6. A process of claim 5 wherein said alkyl mercaptan is tert-butyl mercaptan.

7. A process of claim 5 wherein said aqueous alcohol medium is aqueous isopropanol.

8. A process of claim 7 wherein said tert-alkyl mercaptan is tert-butyl mercaptan.

9. A sulfurized olefin useful as an extreme pressure additive in lubricating oil having improved solubility, said sulfurized olefin being the product made by a process comprising:

(A) reacting a sulfur halide selected from $S_2Cl_2$ and $SCl_2$ with an aliphatic monoolefin containing 3–6 carbon atoms to produce an adduct (B) reacting said adduct with sulfur, $Na_2S$, an alkyl mercaptan containing 1–12 carbon atoms and from 0–0.5 grams NaSH per mol sulfur halide in an aqueous alcohol medium at a temperature of 50° C. up to reflux to form said sulfurized olefin (C) recovering said sulfurized olefin from said aqueous alcohol medium.

10. A sulfurized olefin of claim 9 wherein said sulfur halide is $S_2Cl_2$.

11. A sulfurized olefin of claim 10 wherein said monoolefin is a branched chain monoolefin having 4–6 carbon atoms.

12. A sulfurized olefin of claim 11 wherein said monoolefin is isobutylene.

13. A sulfurized olefin of claim 12 wherein said alkyl mercaptan is a tert-alkyl mercaptan.

14. A sulfurized olefin of claim 13 wherein said tert-alkyl mercaptan is tert-butyl mercaptan.

15. A sulfurized olefin of claim 14 wherein said aqueous alcohol medium is aqueous isopropanol.

16. A sulfurized olefin of claim 10 made by a process comprising (A) reacting one mole of $S_2Cl_2$ with an aliphatic monoolefin containing 3–6 carbon atoms until the exothermic reaction subsides to form an adduct (B) reacting said adduct with about 0.5–1.0 moles of $Na_2S$, 0.1–0.3 moles of NaSH, 0.05–0.15 moles of sulfur and 0.05–0.8 moles of a $C_{1-12}$ alkyl mercaptan in an aqueous alcohol medium at 50° C. up to reflux to form said sulfurized olefin and (C) recovering said sulfurized olefin from said aqueous alcohol reaction medium.

17. A sulfurized olefin of claim 16 wherein said aliphatic monoolefin is isobutylene.

18. A sulfurized olefin of claim 17 wherein said alkyl mercaptan is tert-butyl mercaptan.

19. A lubricating oil composition comprising a major amount of an oil of lubricating viscosity containing a minor extreme pressure improving amount of a sulfurized olefin of claim 9.

20. A lubricating oil composition of claim 19 wherein said olefin is isobutylene, said sulfur halide is $S_2Cl_2$ and said alkyl mercaptan is tert-butyl mercaptan.

21. A lubricating oil composition of claim 19 wherein at least part of said oil of lubricating viscosity is a synthetic $C_{6-12}$ $\alpha$-olefin oligomer.

22. A lubricating oil composition comprising a major amount of an oil of lubricating viscosity and a minor extreme pressure improving amount of a sulfurized olefin of claim 16.

23. A lubricating oil composition of claim 22 wherein said aliphatic monoolefin is isobutylene.

24. A lubricating oil composition of claim 23 wherein said alkyl mercaptan is tert-butyl mercaptan.

* * * * *